US006035946A

United States Patent [19]

Studley et al.

[11] Patent Number: 6,035,946

[45] Date of Patent: Mar. 14, 2000

[54] ENTRY TOOL FOR OPENING SECURED DOORS

[75] Inventors: Charles F Studley, Ft. Myers; Emory E Cross, Arcadia, both of Fla.

[73] Assignee: The Right Equipment Company of Pinnellas County, Inc., St. Petersburg, Fla.

[21] Appl. No.: 09/123,070

[22] Filed: Jul. 27, 1998

[51] Int. Cl.[7] ..... B25D 1/04

[52] U.S. Cl. ..... 173/90; 173/91; 173/128

[58] Field of Search ..... 173/90, 91, 128; 29/255, 254, 278; 254/131; 227/147

[56] References Cited

U.S. PATENT DOCUMENTS

| | | | |
|---|---|---|---|
| 611,103 | 9/1898 | Chancey | 29/254 |
| 1,536,319 | 5/1925 | Yost | 29/278 |
| 2,490,684 | 12/1949 | Grosselin | 29/275 |
| 3,050,095 | 8/1962 | Prather | 193/91 |
| 3,113,478 | 12/1963 | Hall, Jr. et al. | 173/91 |
| 4,211,446 | 7/1980 | Shultz, Sr. | 254/131 |
| 4,429,562 | 2/1984 | Hultquist | 227/147 |
| 4,470,440 | 9/1984 | Thor | 173/90 |
| 4,703,549 | 11/1987 | Grandt | 173/91 |
| 5,088,174 | 2/1992 | Hull et al. | 29/254 |
| 5,167,043 | 12/1992 | Lopez et al. | 29/254 |
| 5,699,864 | 12/1997 | Dvorak et al. | 173/91 |

*Primary Examiner*—Scott A. Smith
*Assistant Examiner*—James P. Calve
*Attorney, Agent, or Firm*—Laura G. Barrow

[57] ABSTRACT

Disclosed is an improved forcible entry tool for opening locked or jammed doors by emergency personnel for the purpose of apprehending criminal suspects, gathering evidence, and preserving lives of people who become trapped by fire, earthquake, tornadoes, or by other circumstances beyond their control. The tool of the present invention comprises an elongated frame with a piercing pivot blade on the front end of the tool. The pivot blade is configured to pivot perpendicular to the frame upon penetration through a door, thereby enabling the tool operator to effectively pull back on the tool to break open an outwardly swinging door. A detachable ram head may be mounted over the front end of the frame for purposes of breaking through a door that swings inward (i.e. away from the tool operating personnel).

5 Claims, 2 Drawing Sheets

ENTRY TOOL FOR OPENING SECURED DOORS

BACKGROUND OF THE INVENTION

In emergency situations where access into a building or room is critical, such as to save lives or property, for example, gaining access through locked, jammed, or otherwise secured doors must be accomplished as rapidly as possible in order to protect human life and to preserve evidence for use in prosecuting unlawful acts. Currently, the procedure in use to gain entry through locked or jammed doors that open inward is to use a battering ram or heavy hammer to destroy the door. The procedure currently used to open doors that open outward is to pry the door open using pry bars, screwdrivers, and the like. Both procedures in use today take too much time, thereby placing both human lives and/or evidence of a crime at risk. Thus, it is desirable to have a tool that will enable emergency personnel faster access through such doors.

The results of an informal search were minimal. We found a battering ram to be the only specialized piece of equipment dedicated to this specific task.

SUMMARY OF THE INVENTION

The present invention is directed to a forcible entry tool for opening secured doors in the event of an emergency. Since time is of the essence in an emergency situation, the present invention comprises an improved tool design for breaching locked or secured doors as quickly as possible.

Specifically, the present invention is directed to an entry tool for opening secured doors comprising an elongated frame with a longitudinal axis, the frame further having a first end and a second end. The first end may be tapered or beveled. The tool also includes a first striking plate disposed near the first end of the elongated frame and a second striking plate adjacent the second end of the frame. The tool includes a sliding weight disposed on the frame and configured to move along the frame to strike the first striking plate or the second striking plate. A pivot blade is pivotally attached to the first end of the elongated frame, the pivot blade also having a longitudinal axis. The tool further includes pivot blade collar slidingly retained on the elongated frame, wherein the pivot blade collar can slide along the elongated frame and over the pivot blade for retaining the longitudinal axis of the pivot blade in alignment with the longitudinal axis of the elongated frame.

In other aspects of the invention, the pivot blade has a first end and a second end, each having different weights respectively, such that when the pivot blade collar slides along the frame toward the second end of the elongated frame to release the pivot blade from being in alignment with the longitudinal axis of the frame, the pivot blade pivots so that its longitudinal axis is approximately perpendicular to the longitudinal axis of the elongated frame. In the foregoing embodiments, the tool may be used effectively to break open doors that swing outward (i.e. towards the tool operating personnel).

Other aspects of the present invention include a ram head that may be detachably mounted onto the front (first) end of the frame, over the pivot blade. In this embodiment, the tool may be used effectively as a battering ram to break open doors that swing inward (i.e. away from the tool operating personnel).

DETAILED DESCRIPTION OF THE PREFERRED EMBODIMENTS

Figure 1:
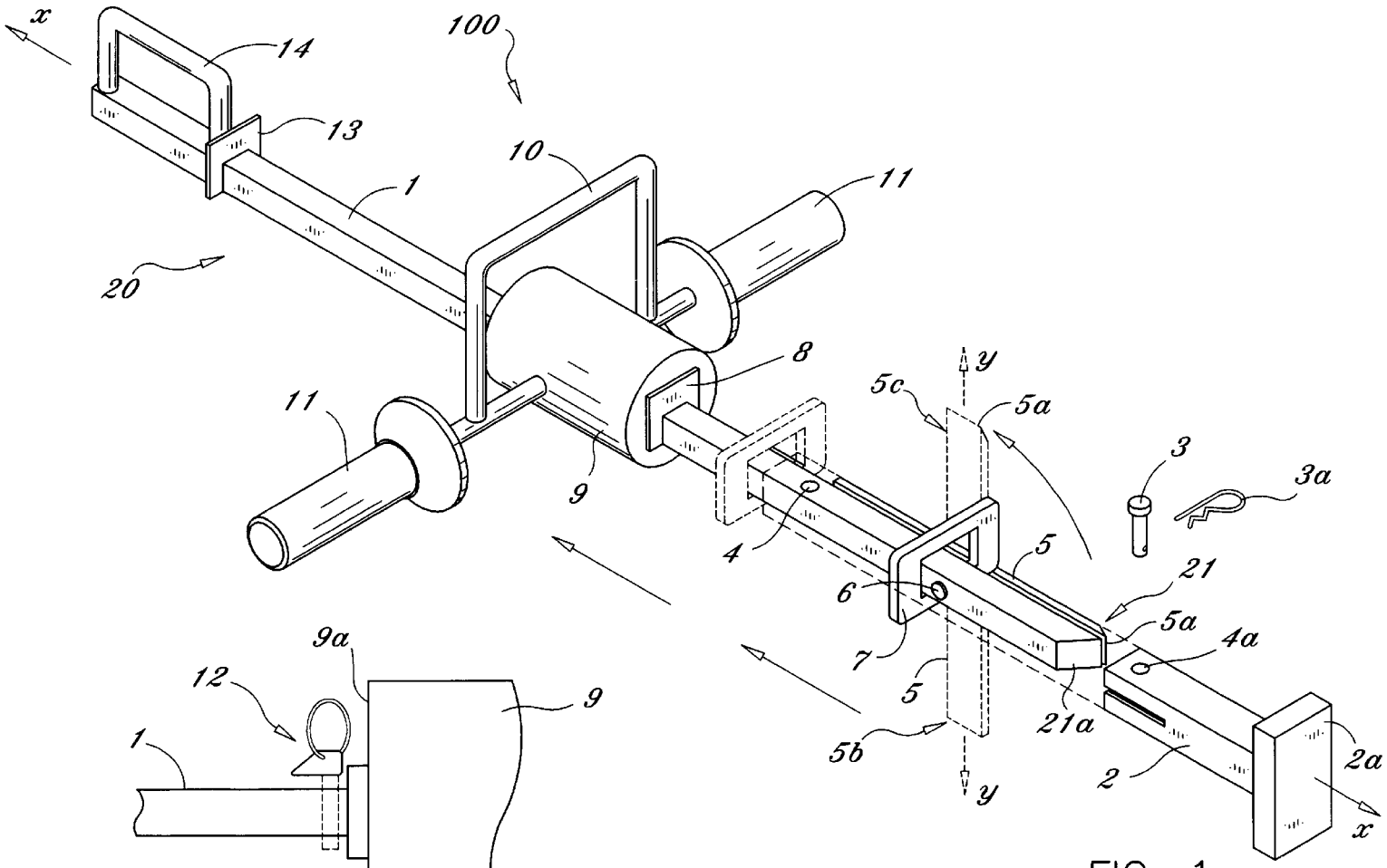
FIG. 1 is an exploded view of the present invention.

The present invention is directed to an improved forcible entry tool for opening secured doors in emergency situations. The inventive tool incorporates features that make it particularly useful in opening secured doors that are designed to open outward (i.e. toward the tool operator), where battering rams are not generally effective absent the use of excessive force.

Referring now to the figures, where like reference numerals and letters refer to like components throughout the various figures, the inventive forcible entry tool (100) comprises an elongated frame (1) having a longitudinal axis (X), and further comprising a front first end (21) and a rear second end (20). The rear end (20) of the frame (1) further includes a striking plate (13) and a handle (14) adjacent to the striking plate (13). A second handle (10) is secured to a sliding weight (9) slidably disposed on the elongated frame (1) of the tool (100). The sliding weight (9) is configured to slide rearwardly against the rear strike plate (13) when force is applied via the front handle (10), as discussed in more detail below. Forward movement of the weight is limited by a front strike plate (8). The inventive tool is designed for use by a single individual via the rear (14) and forward (10) handles or two straight handles (11).

Figure 3:
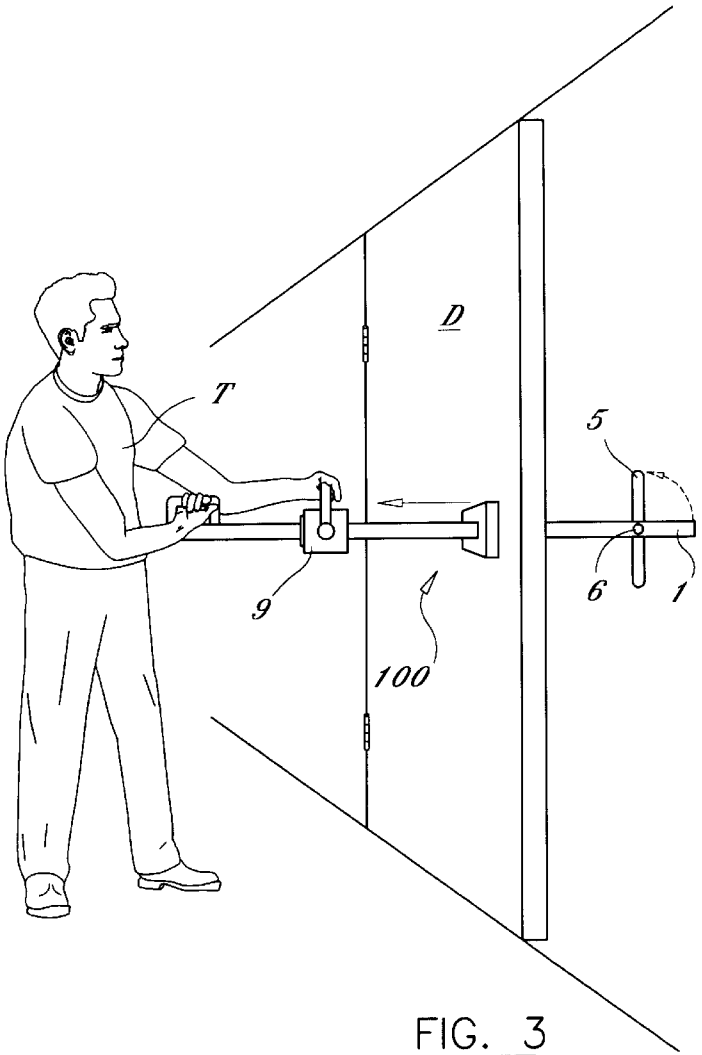
FIG. 3 illustrates use of the inventive tool to penetrate and open a door designed to open outwardly (i.e. toward the tool operator).

The front end (21) of the frame (1) is configured to pierce a door (D), and comprises a pivot blade (5) that is secured to the frame (1) at a pivot point by a pin (6), as shown in FIG. 1. The pivot blade (5) has a piercing edge (5*a*) and is maintained in a piercing position (shown in solid line) by a slidable collar (7) such that the respective longitudinal axes (X,Y) of the pivot blade (5) and frame (1) are in parallel alignment. When a door designed to swing outward (i.e. toward the tool operator (T)) must be removed by force, as shown in FIG. 3, the tool (100), with pivot blade (5) in piercing position as described above, is grasped at the handles (14, 10) and forcibly swung against the door (D). The force of the tool (100) against the door (D), aided by the momentum of the sliding weight (9), causes the pivot blade (5) in combination with the front end (21) of the frame (1) to effectively penetrate the door (D). Preferably, the front end (21) of the frame (1) and the piercing end (5*a*) of the pivot blade (5) are beveled with a sharp edge (21*a*) to more effectively pierce the door (D), as shown in FIG. 1. As the door (D) is penetrated by the tool (100), the collar (7) that originally maintained the pivot blade (5) in piercing position is pushed rearward by, and away from, the door (D), its rearward movement impeded by a second striking plate (8) disposed in front of the sliding weight (9). As the collar (7) moves completely away from the pivot blade (5), as shown in phantom lines, the pivot blade (5), which is weighted on one end (5*b*), pivots about the pivot pin (6) via gravity such that its longitudinal axis (Y) is substantially perpendicular to the longitudinal axis (X) of the elongated frame (1), as shown in phantom lines in FIG. 1. (This pivoting action can be achieved by mounting the pivot blade onto the frame just ahead of its center of gravity balance point, such that one end (5*b*) is necessarily heavier than the opposite end (5*c*)). In this position (FIG. 3), as the sliding weight (9) is forcibly pulled rearward, striking the rear strike plate (13), the pivot blade (5) is slammed against the door (D) above and below the pivot point pin (6), thereby breaking the door lock(s) or the door jam to more effectively and quickly remove the door from entry way.

Figure 1A:
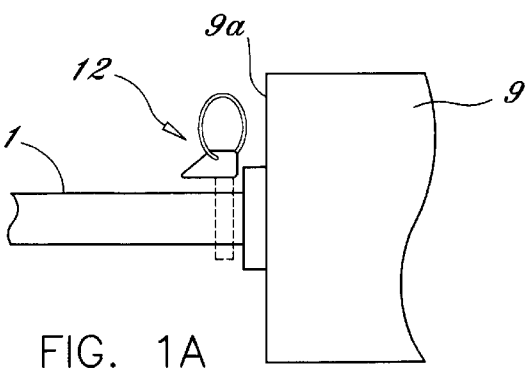
FIG. 1A is a partial view of the locking mechanism for the sliding weight of the present invention.
Figure 2:
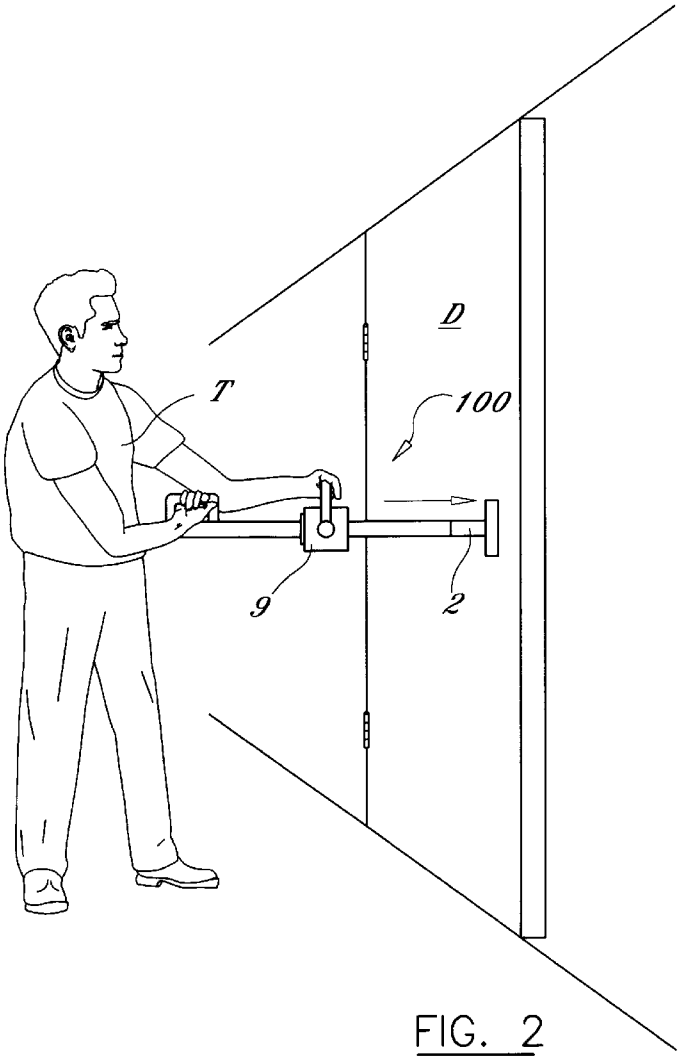
FIG. 2 illustrates use of the inventive tool as a battering ram to open a door designed to open inwardly (i.e. away from the tool operator).

The inventive tool (100) may also be used as a battering ram to break through doors designed to open inward (i.e. away from the tool operator (T)). Prior to use, a detachable ram head (2) is secured to the front end (21) of the frame (1), as shown in FIGS. 1 and 2. The ram head (2) is telescopically mounted onto the frame (shown in phantom lines) and locked into place by a pin (3) that is engaged within corresponding bores (4*a*, 4) communicating through the ram head (2) and frame (1), respectively. The pin (3) may be further locked into place by a cotter pin (3*a*). The tool (100) may then be swung in an arc across the tool operator's (T) body and against the door (D), the broad end (2*a*) of the ram head striking the door (D) to break the jam or locking mechanisms of the door (D) for subsequent entry therethrough (FIG. 2). Prior to use, the sliding weight (9) of the tool (1) may be prevented from sliding rearward by a second pin (12), shown in FIG. 1A, engaged within a corresponding bore communicating through the frame (1) adjacent the rear end (9*a*) of the weight (9) to secure the weight (9) between the front striking plate (8) and the second pin (12).

What I claim is:

1. An entry tool for opening secured doors comprising:

an elongated frame with a longitudinal axis, said elongated frame having a first end and a second end;

a first striking plate disposed near the first end of said elongated frame;

a second striking plate adjacent the second end of said elongated frame;

a sliding weight disposed on said elongated frame, wherein said sliding weight is configured to move along said elongated frame to strike said first and second striking plates;

an elongated pivot blade pivotally attached to said first end of said elongated frame, said pivot blade having a longitudinal axis; and a pivot collar slidingly retained on said elongated frame, wherein said pivot blade collar is configured to slide along said elongated frame and over said pivot blade, thereby retaining the longitudinal axis of said pivot blade in alignment with the longitudinal axis of said elongated frame.

2. The entry tool of claim 1, wherein said first end is beveled.

3. The entry tool of claim 1, wherein said pivot blade has a first end and a second end, said first and second pivot blade ends being of different weights, such that when said pivot blade collar slides along said elongated frame toward said second end of said elongated frame to release said pivot blade from being in alignment with the longitudinal axis of said elongated frame, said pivot blade pivots so that its longitudinal axis is approximately perpendicular to the longitudinal axis of said elongated frame.

4. The entry tool of claim 3, wherein said first end is beveled.

5. The entry tool of claim 1, further including a ram head detachably mounted on said first end of said elongated frame.

* * * * *